US005979900A

United States Patent [19]

Goldfarb et al.

[11] Patent Number: 5,979,900

[45] Date of Patent: Nov. 9, 1999

[54] GAME WITH DISPLAY AND ACTION-DISCHARGE

[75] Inventors: Adolph E. Goldfarb, Westlake Village; Martin I. Goldfarb, Santa Monica, both of Calif.

[73] Assignee: Eddy & Martin Goldfarb and Associates, LLC, Northridge, Calif.

[21] Appl. No.: 09/127,997

[22] Filed: Jul. 31, 1998

Related U.S. Application Data

[63] Continuation-in-part of application No. 08/944,079, Oct. 4, 1997, Pat. No. 5,823,538, which is a continuation-in-part of application No. 08/796,713, Feb. 6, 1997, Pat. No. 5,704, 610.

[51] Int. Cl.[6] ..... A63B 71/00

[52] U.S. Cl. ..... 273/445; 273/440; 273/457; 273/459; 273/460

[58] Field of Search ..... 273/349, 459, 273/457, 440, 445, 460

[56] References Cited

U.S. PATENT DOCUMENTS

| | | | |
|---|---|---|---|
| 3,933,354 | 1/1976 | Goldfarb et al. | 273/445 |
| 5,195,751 | 3/1993 | Senart | 273/459 X |
| 5,263,714 | 11/1993 | Rudell et al. | 273/457 |
| 5,470,082 | 11/1995 | Clayton | 273/445 |
| 5,678,825 | 10/1997 | Clayton | 273/445 |
| 5,823,538 | 10/1998 | Goldfarb et al. | 273/445 |

*Primary Examiner*—Raleigh W. Chiu
*Attorney, Agent, or Firm*—Ashen & Lippman

[57] ABSTRACT

In one form of game the player observes and must quickly respond to the rapidly changing conditions of one or more visually observed displays such as lights to avoid being sprayed by a liquid discharge. The games is so constructed that to effectively play the game the player must generally continuously observe the condition of the lights; to do so the player must maintain her face in position to be sprayed. In another preferred embodiment, the visually observed display is a screen such as a LCD on which changing action images appear. The player interacts by controlling a portion of the images in response to the action of other of the images and in accordance with the predetermined manner of play of the game. When she is not successful, she receives a spray.

14 Claims, 10 Drawing Sheets

GAME WITH DISPLAY AND ACTION-DISCHARGE

RELATED APPLICATION

This application is a Continuation-in Part of U.S. application Ser. No. 08/944,079 filed Oct. 4, 1997, now U.S. Pat. No. 5,823,538, which is a Continuation-in-Part of U.S. application Ser. No. 08/796,713 filed Feb. 6, 1997 now U.S. Pat. No. 5,704,610.

FIELD OF THE INVENTION

Games having a physical action component directed at the players.

BACKGROUND OF INVENTION

Children love competitive action games that involve a degree of suspense and excitement. Often in such games, at some point an action occurs such as a light going on or a siren going off or something falling down. Children also enjoy participating in and causing the action and/or trying to prevent the action. There is further play value in having to react or do something once the action takes place.

SUMMARY OF ILLUSTRATED APPARATUS EMBODYING THE PRESENT INVENTION

The drawings illustrate several forms of the invention.

In one form, the game apparatus is so constructed and arranged as to require a desired portion of the player's body such as her face to be maintained in a player location or area in order for her to effectively play the game. At times dictated by the play of the game, the liquid or other discharge is directed to that player areas and thus at the player. The illustrated game apparatus has a housing with a front face. At least one elongated channel extends from the front face into the housing. Each channel has an open entrance at the front face and a visually observable display such as a light located a substantial distance down into the channel so that the player must align her line of sight with the channel to effectively see the condition (e.g., on or off) of the light. A discharge mechanism such as a spray nozzle operated by a pump is positioned on the front face adjacent to the channel entrance so that when a spray is discharged from the nozzle, it will necessarily strike the adjacent face of the player. In the play of the game, the lights sequentially go on and then off in a rapid but random or apparently random sequence. The player must closely follow the condition of the lights and take action as by depressing a button when a light comes on and before it goes off. Otherwise, the player receives a spray in the face.

In another presently preferred embodiment of game apparatus the player views animation or other visual action displayed on a small LCD screen, and must respond in a prescribed manner to the action on the screen or receive a liquid discharge or spray in the face. For example, a display figure movable side-to-side on the display by the player may be trying to catch large falling drops of water. If the figure misses a falling drop, the player receives a spray.

IN THE DRAWINGS

DETAILED DESCRIPTION OF THE DRAWINGS

Embodiments of FIGS. 1 through 6

FIGS. 1 through 6 illustrate another game apparatus 400 which embodies a presently preferred embodiment of the invention. This game apparatus 400 is so designed and configured that the user must generally continuously position her face at a particular player area or location to be able to effectively participate in the play of the game as by observing visually observable display or indicator means. This player location also positions the user's face adjacent to the discharge means so that a discharge will strike the user in her face. This ensures that a player participating in the play of the game cannot avoid the discharge when it occurs.

Figure 1:
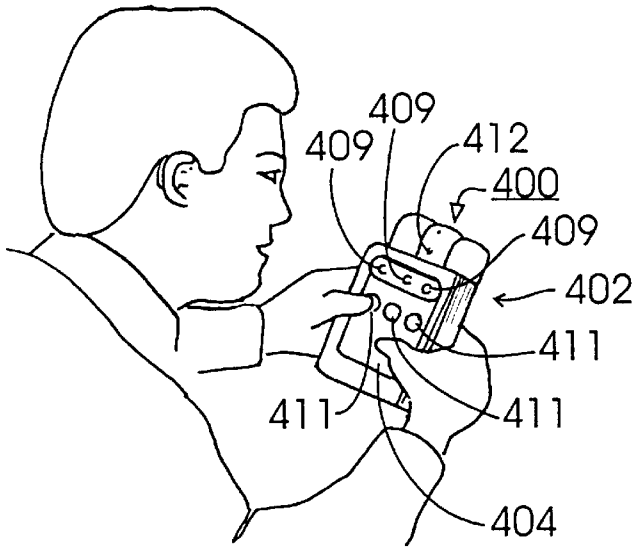
FIG. 1 is a schematic perspective view of a player holding a hand-held alternative embodiment of the game apparatus.
Figure 2:
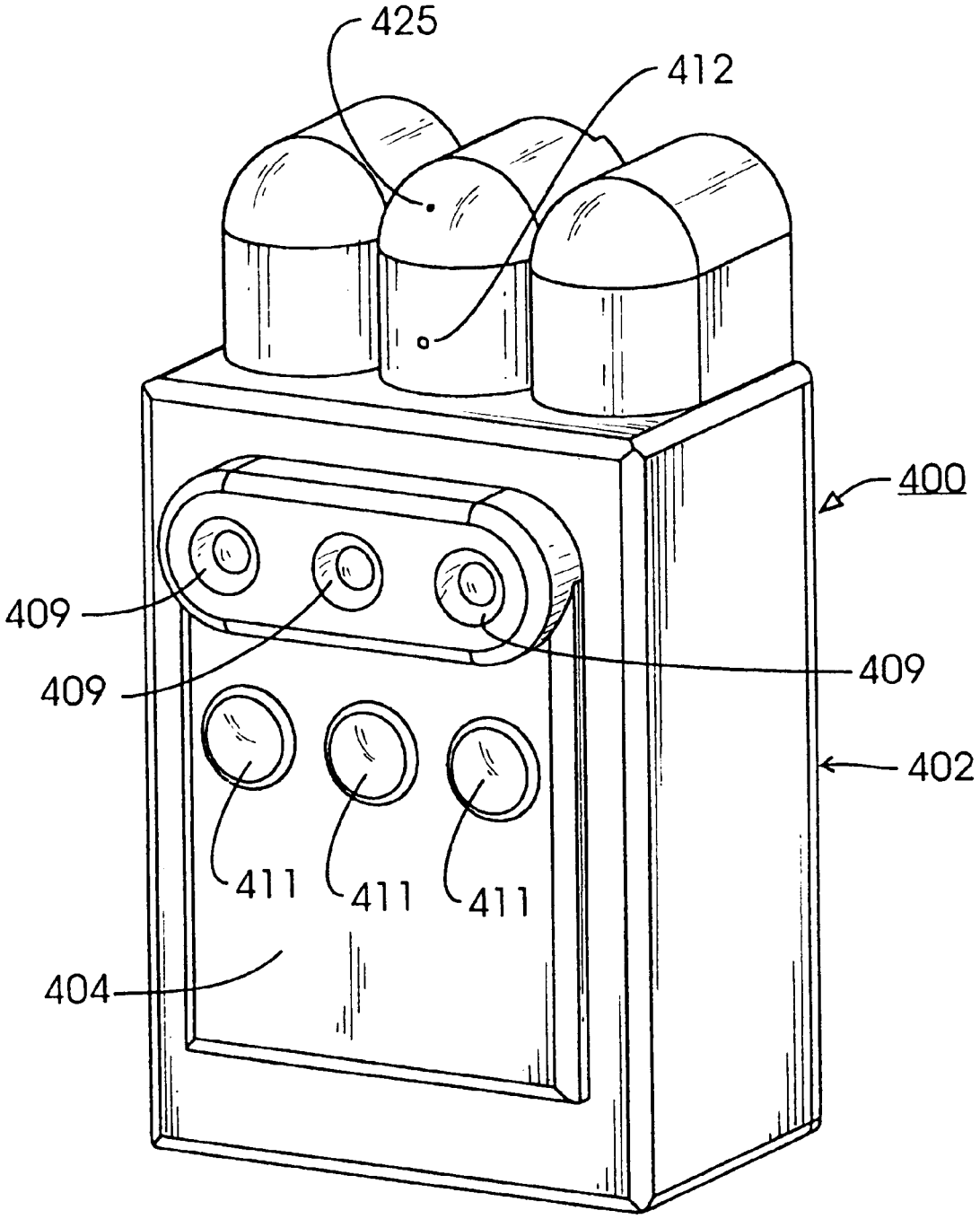
FIG. 2 is an enlarged front perspective view of the exterior of the game apparatus of FIG. 1.

FIG. 1 illustrates the game apparatus 400 being held by a player. Game apparatus 400 is in the form of a hand-held unit having a case or housing 402 having a front face 404. The housing 402 has is at least one elongated channel 408 that has an open outer end or entrance 409 at the front face 404 and extends a substantial distance into the housing. In each channel 408 a visually observable indicator or display 410 is positioned a substantial distance from the channel entrance 409. This construction requires that the player position her face with her eyes generally directly in line with the channel 408 to be able to effectively see and determine the condition, such as on or off, of the display 410. In the preferred embodiment 400 there are a plurality of channels 408.

A liquid discharge nozzle 412 is located on the housing front face 404 adjacent to the channel 408, so as to direct its discharge flow at the face of the player looking into the channel. The player may be given only a limited amount of time to respond to the condition of the display as by operating an associated response means such as a depressable button 411 also on the housing front face. Failure to correctly respond in time causes a discharge from the nozzle against the player's face.

In the play of the illustrated game apparatus 400, the visual displays 410 sequentially and rapidly turn on and off in a random or apparently random order. When each display 410 goes on, the player attempts to quickly depress the associated button 411 before the display goes off. Whenever a button 411 is not depressed quickly enough or the wrong button is depressed, the player receives a spray in the face from the nozzle 412.

More particularly, as shown in FIGS. 2 through 5, the hand-held game apparatus 400 includes the generally rectangular casing or housing 402. Mounted on the front face 404 of the housing, in a line extending side by side at about the center of the face, are three response buttons 411. Also on the front face 404 and in a line side by side, each aligned with one of the buttons 411, are openings or entrances 409 to three channels 408. The channels 408 each extend a substantial distance into the housing. Each response button 411 is associated with the aligned channel 408. A visually observable display 410 in the form of a small light emitting element such as an LED is located within each of the three channels 408, a substantial distance from the associated channel entrance 409. LEDS are cheap and practical, and thus generally preferred, but other light emitting elements such as incandescent bulbs might be utilized. Using relatively narrow channels and positioning the LED a substantial distance from the channel entrances requires that the eyes of the player be kept generally aligned with the channels. Otherwise the player cannot effectively observe the changing condition of the LEDS within the channels. In practice, cylindrical channels each having a diameter of about one quarter of an inch and a length from entrance to LED of about one and one-half inches operates effectively to require the face of the player to be positioned closely adjacent to the channel entrances.

The liquid discharge nozzle 412 is located adjacent to and centrally above the channel entrances 409 so that when the player aligns the channels 408 with her line of sight as shown in FIG. 1, the liquid discharge or spray from the nozzle 412 will be directed against the player's face such as her forehead. The position of the nozzle 412 ensures that it will not be covered over or obstructed by the player's hand that hold the unit.

As noted above, the LED 410 may go on and off rapidly in a different random or apparently random order for each player turn or round. Thus an individual LED 410 may turn on for a limited predetermined time period and then go off as another of the LED turns on for its limited predetermined time period, and so on. If the player does not successfully depress the associated button 411 (or depress a wrong button) before the LED 410 goes off, she will be sprayed from the nozzle 412.

It is important that the game be constructed and played so as to ensure the generally continuous need for the player to maintain observation of the visual display, which in turn maintains the player in position to be sprayed. In this connection and for this purpose, the randomness of the sequence of displays has been noted. If there were only a single display-and-button combination, the need for generally continuous observation could be ensured by varying the intervals between the displays being on and/or requiring that the response begin within a limited time after a display goes on and that it continue until the display goes off.

Figure 3:
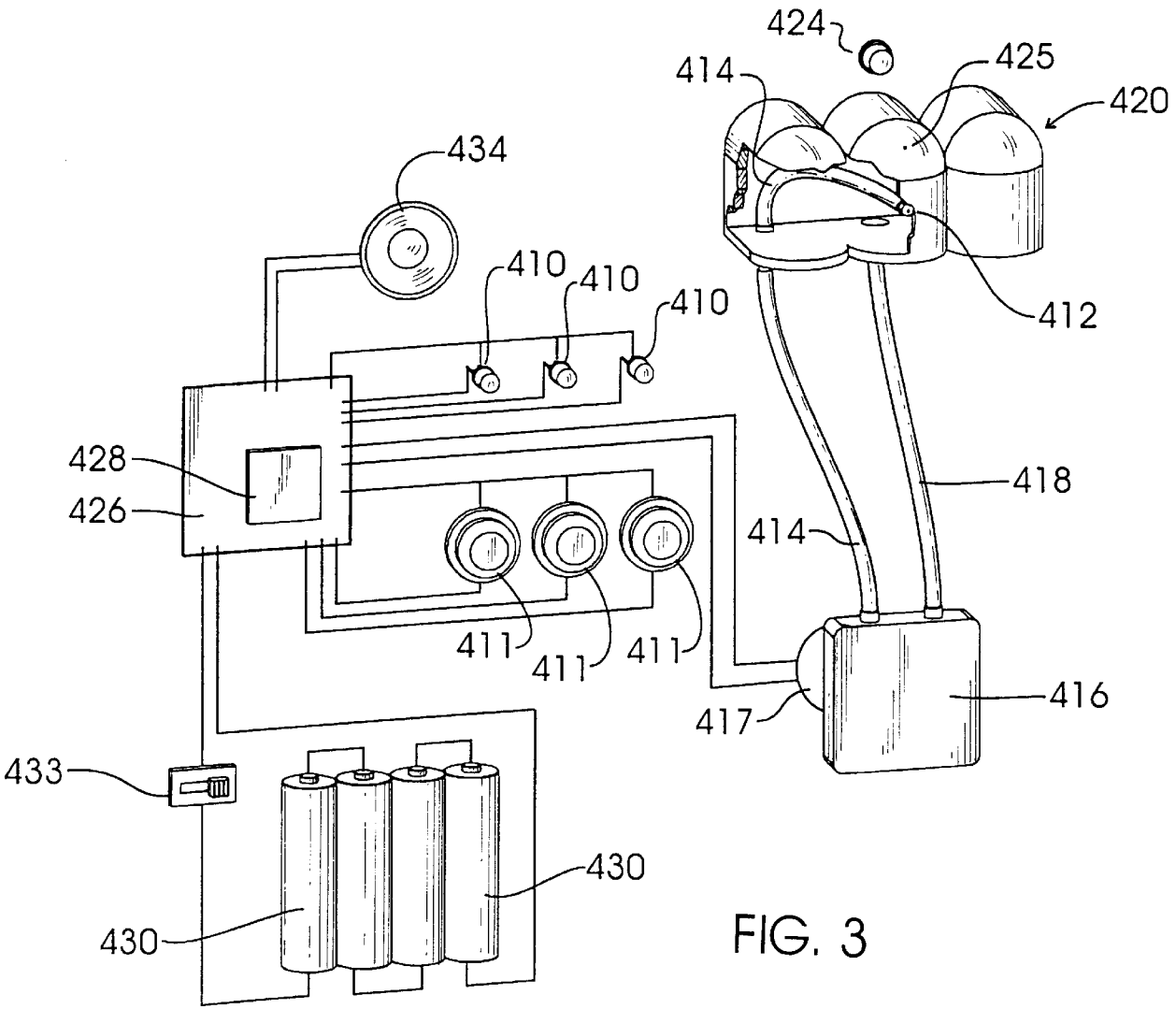
FIG. 3 is a schematic and diagrammatic showing of components of the game apparatus of FIG. 1, and of the connections between the components.
Figure 5:
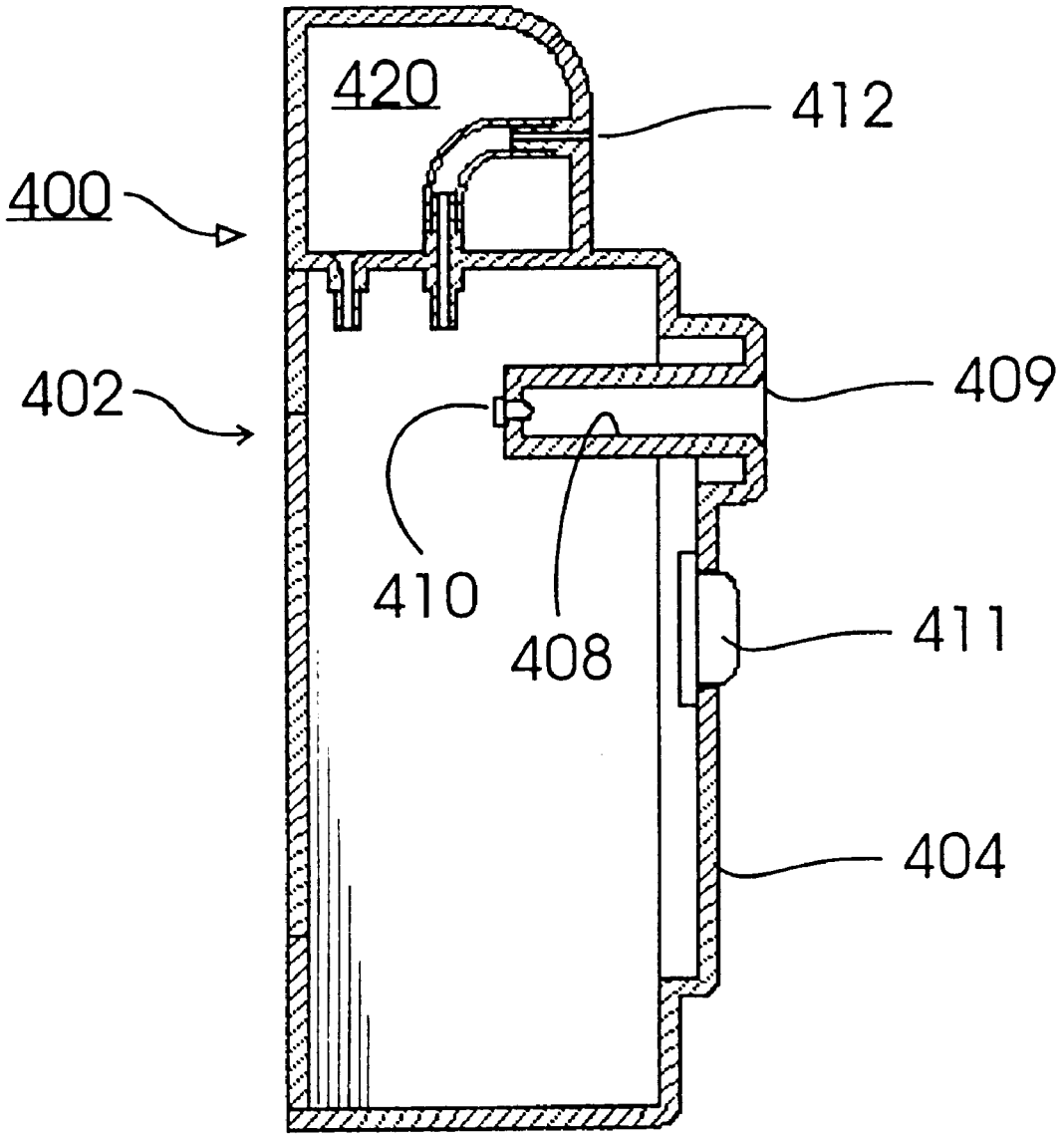
FIG. 5 is a further enlarged side sectional view taken generally along line 5—5 of FIG. 4.

FIG. 3 illustrates in a schematic and diagrammatic way the various components of the hand-held game apparatus 400, and the connections between the components.

The illustrated nozzle 412 is connected through a first conduit 414 to a standard liquid pump 416 mounted in the housing 402. The pump 416 may be operated by a standard electric motor 417 which may be powered by a set of replaceable batteries 430. The pump 416 is in turn connected through a second conduit 418 to a liquid-holding tank or section 420 formed by the upper portion of the housing 402. The tank 420 is thus located above the pump 416. The tank 420 has a filling opening with a removable plug 424. The plug 424 can be accessed and removed from the outside of the housing 402 so that the tank 420 can be periodically filled and refilled by the player as needed. The tank 420 has an air vent 425.

The game apparatus 400 includes a circuit board 426 on which a preprogramed computer chip 428 is mounted. The chip 428 controls the operation of the game. The chip 428 may be powered by the set of batteries 430. The illustrated batteries 430 are mounted in a suitable compartment within the housing 402 and are accessible by removing a cover 431. The chip 428 may be electrically connected by suitable standard connections to the LEDS 410, to the depressable buttons 411, and to a speaker 434. Further, the chip may be electrically connected to the pump motor 417.

When the game is turned on, as by an on/off switch 433, a player turn begins. The chip 428 sends signals to the LEDS 410 to cause them to sequentially turn on and off in random or apparently random order, each for a predetermined time period. Whenever one of the lit LEDS 410 goes off before the associated button 411 has been depressed by the player (or the wrong button is depressed), the chip 428 turns on the motor 417. This operates the pump 416 to discharge liquid from the nozzle 412. As emphasized above, since the player must align her eyes with the channels 408 to effectively observed the condition (on or off) of the LEDS 410, the face of the player will necessarily be positioned in front of the nozzle 412 to so as to receive a spray from the nozzle when the player fails to depress the right button 411 in time or depresses the wrong button. In the illustrated apparatus 400, the chip 428 automatically shuts off the spray after a brief period. This arrangement is preferred to a manual stop or off switch as it avoids spraying excess liquid into the surrounding environment.

Alternatively, instead of responding to a single lit LED, the game may be arranged so that the player responds to a series or sequence of lit LEDS, attempting to press buttons corresponding to the sequence.

A player turn may end after a predetermined time period or number of lit LEDS. A new player turn may then be commenced.

Figure 4:
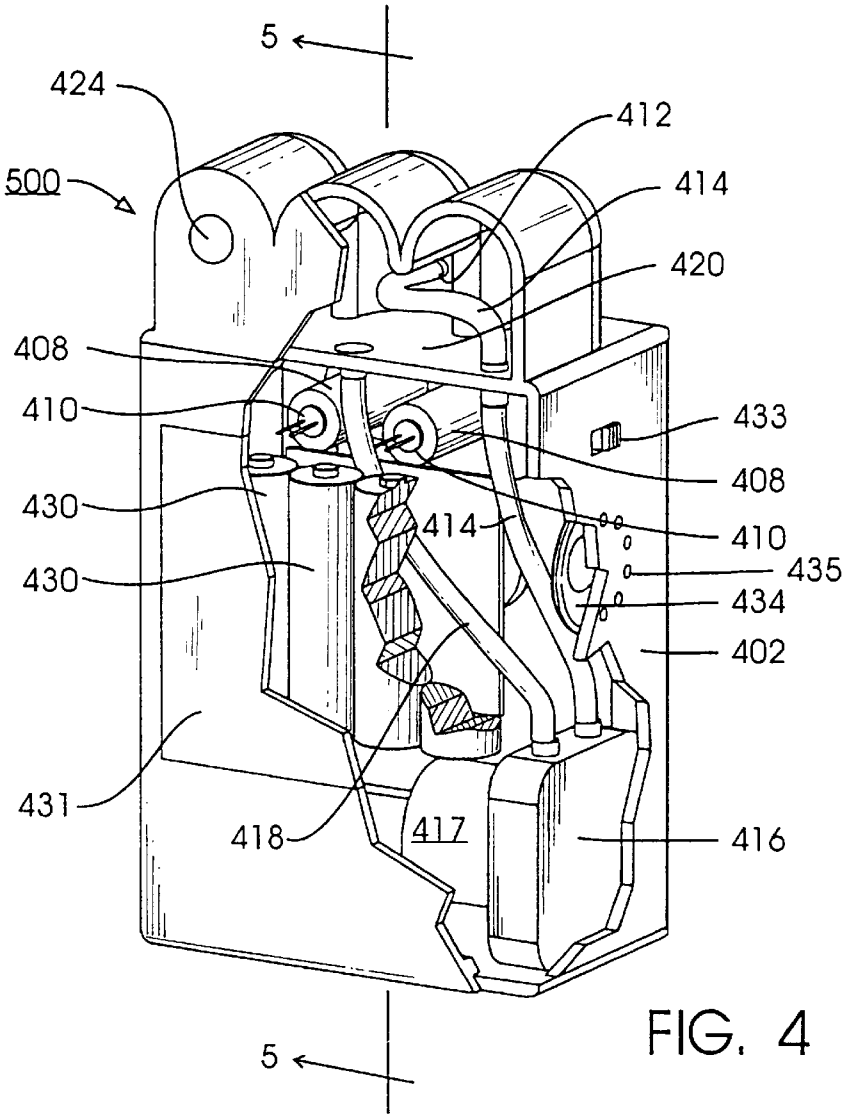
FIG. 4 is a rear perspective view of the game apparatus of FIG. 1 with portions broken away to reveal details of construction.

FIG. 4 shows the placement of the components in the illustrated housing 402.

The pump 416 is in the lower end of the housing 402. The first conduit 418 extends down to the pump 416 from the tank 420 that is formed in the upper portion of the housing 402. The second conduit 414 extends from the pump 416 up to the nozzle 412, which is at the upper end of the housing at the housing front face 404. Three cylinders that each provide one of the channels 408 are supported with their entrances 409 at the housing front face 404. The entrances 409 are located a short distance below the nozzle 412. At the rear end of each channel 408 one of the LEDS 410 is supported. (See FIGS. 4 and 5). The batteries 430 are supported in the compartment that extends across the rear of the housing. The compartment has the openable cover 431. The on/off switch 433 is at the side of the housing 402, as is a set of speaker openings 435 to facilitate emission of sound from the speaker 434.

Figure 6:
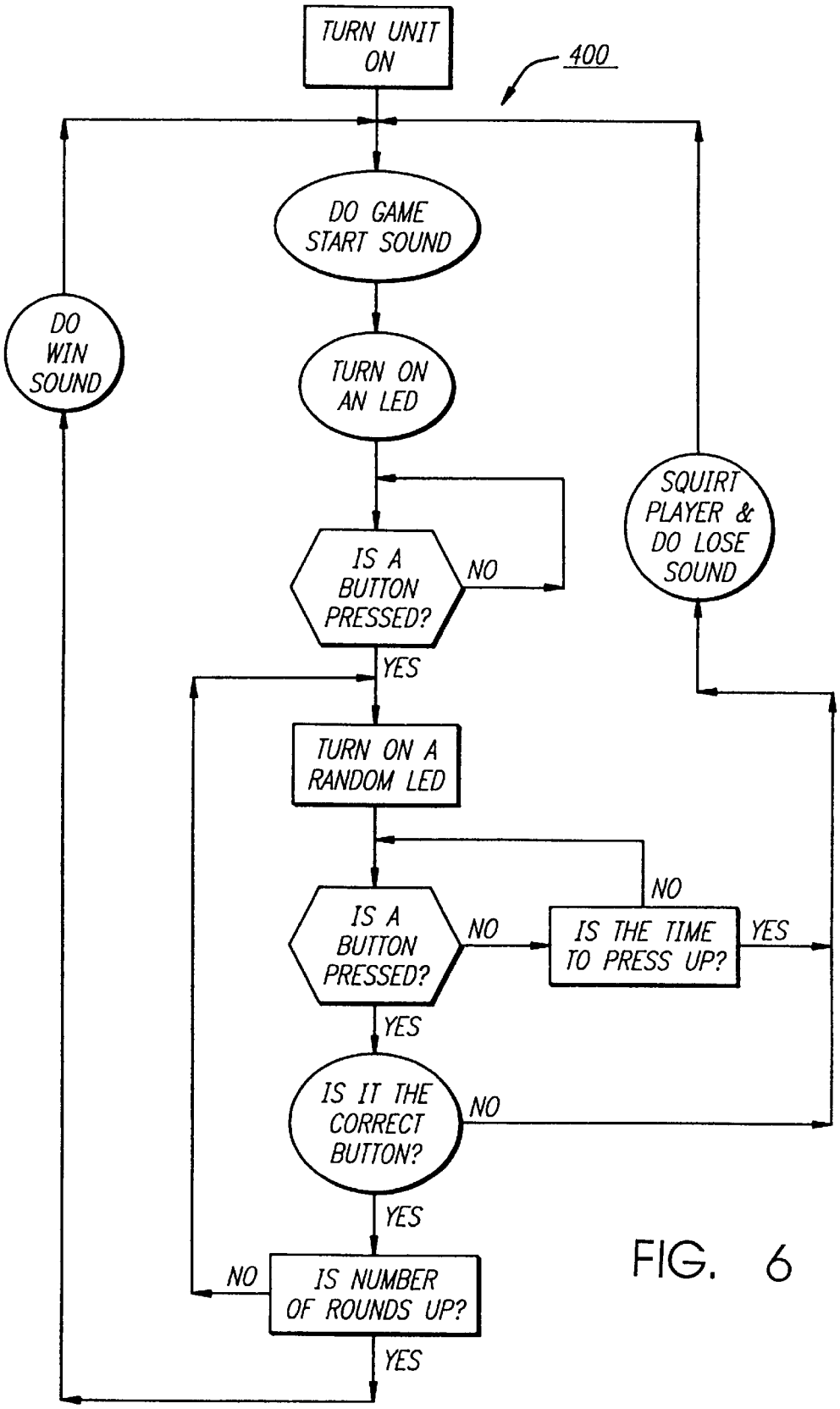
FIG. 6 is a flow chart showing the operation of the game apparatus of FIG. 1.
Figure 8:
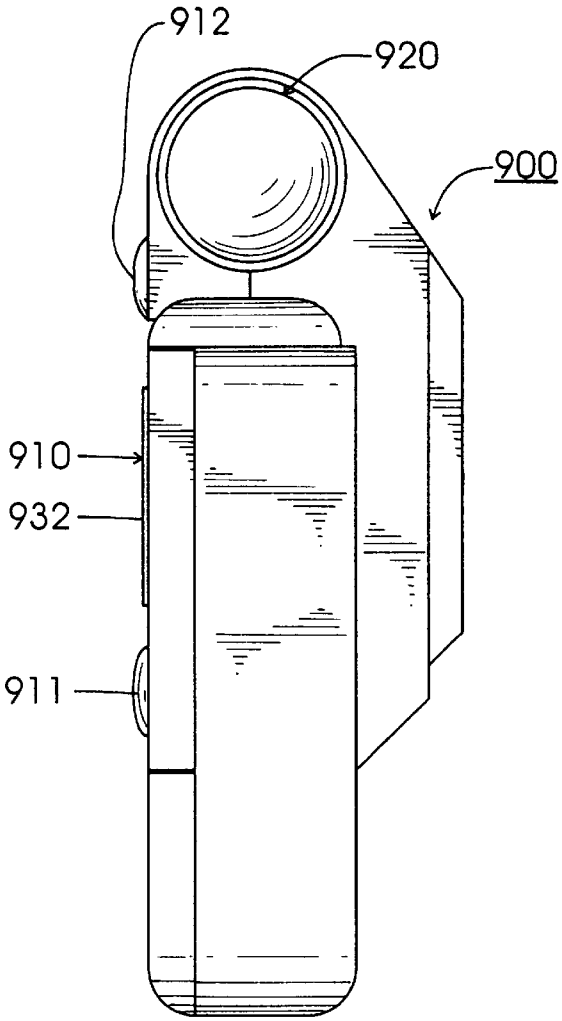
FIG. 8 is a side view of the game apparatus of FIG. 7.
Figure 7:
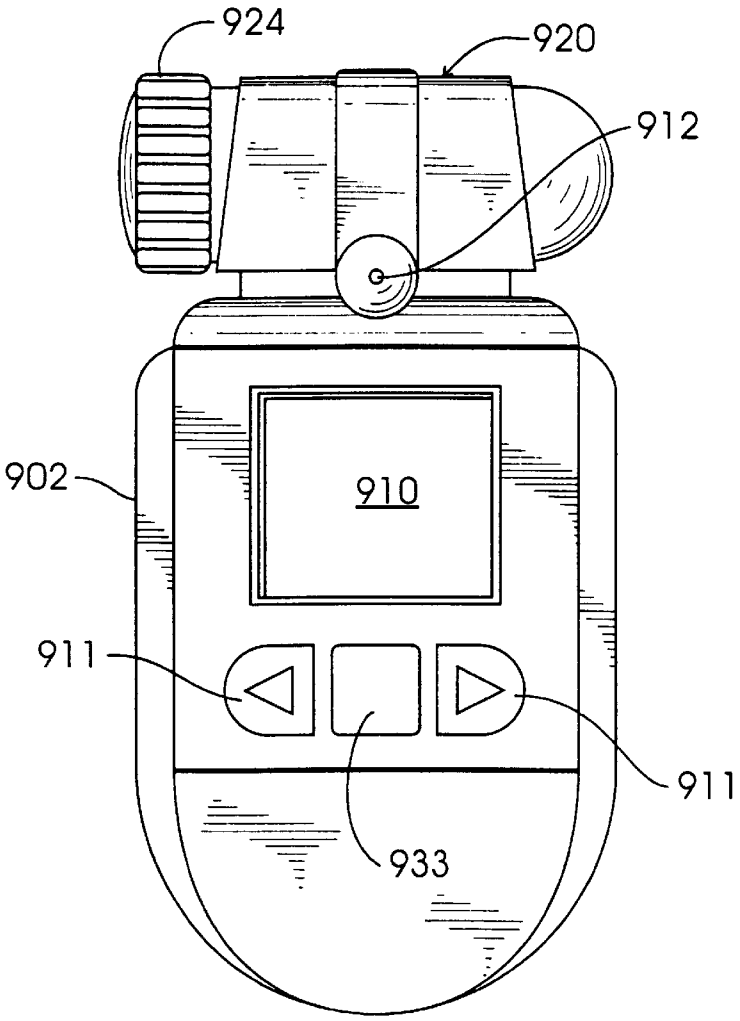
FIG. 7 is a front view of an alternate embodiment of the game apparatus.
Figure 9:
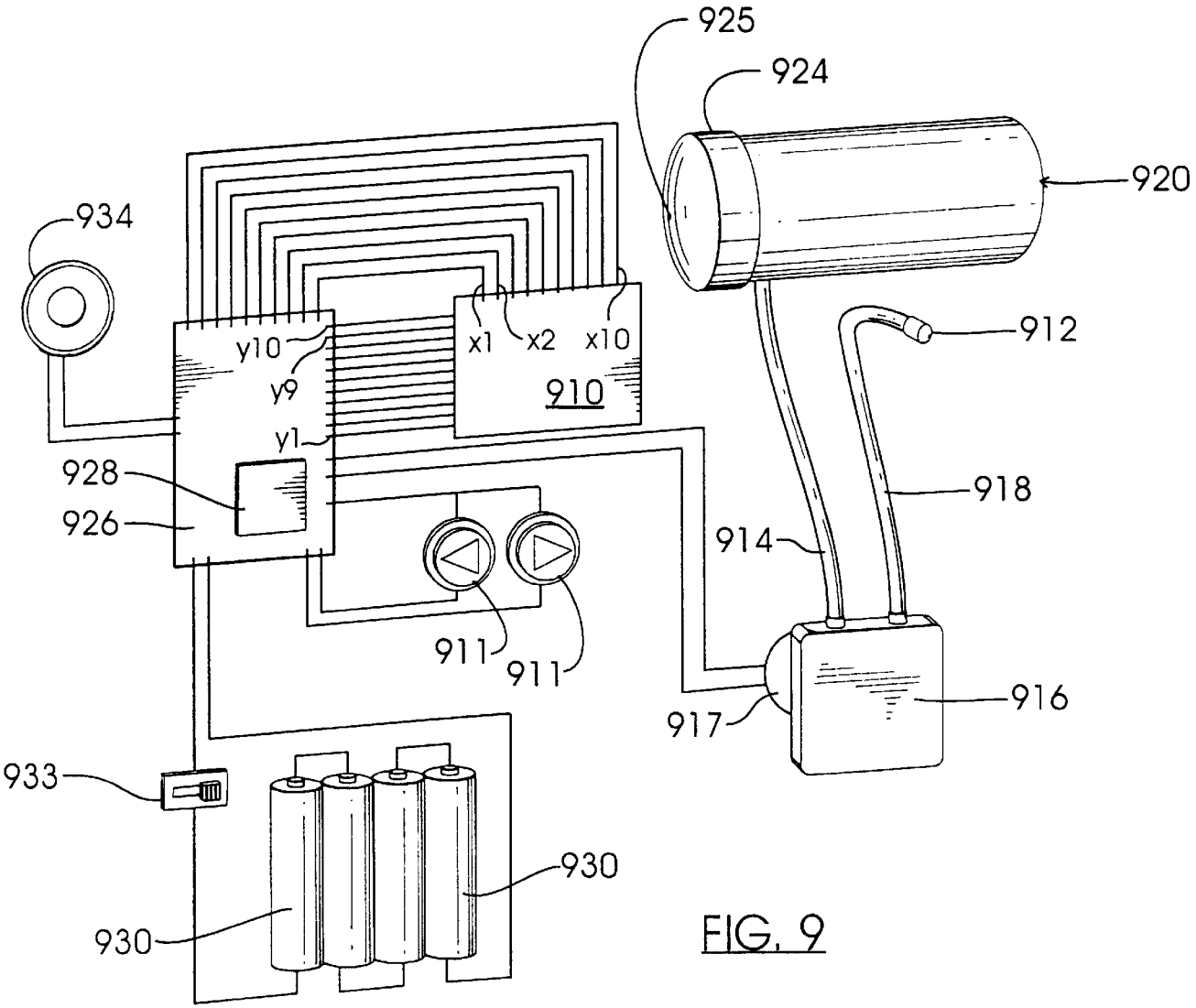
FIG. 9 is an enlarged and exploded schematic perspective view of the components of the game apparatus of FIGS. 7 and 8.

FIG. 6 is a flow chart showing in detail the steps in the operation of game 400.

In another presently preferred embodiment of the game, as shown is FIGS. 7–12, the game apparatus 900 is a hand-held unit generally similar to embodiment 400. In this regard, apparatus 900 may have a water storage and spray system and electrical circuitry essentially like apparatus 400. It may also have manual actuating or responsive buttons 911 like buttons 411 of apparatus 400 for the user to actuate in response to what she observes.

In place of the viewing tube 408 and the lights 410 of embodiment 400, the apparatus 900 has an LCD screen 910 which is capable of displaying a variety of animated or other visual effects. For example, it might show large falling drips of water and an animated figure with a bucket for catching the drops. The player may then operate the buttons or other response or control means to position the animated figure to catch the drops as they fall.

The nature of the LCD screen 910 generally requires the user to place her eyes and face directly in front of the screen to secure a clear vision of the action taking place on the screen. As she moves away from directly in front of the screen, the images becomes more and more difficult to observe and follow. Thus as a practical matter, the user is required to keep her face generally in front of the screen during play of the game, and thus in line with the discharge nozzle 912.

In the illustrated preferred embodiment 900, a peripheral wall or lip 932 is provided around the edge of the LCD screen 910. The lip 932 restricts vision of the screen as the user moves way from directly in front of the screen. The lip may further shield the screen from side light, to improve the viewability of the screen.

Figure 10A:
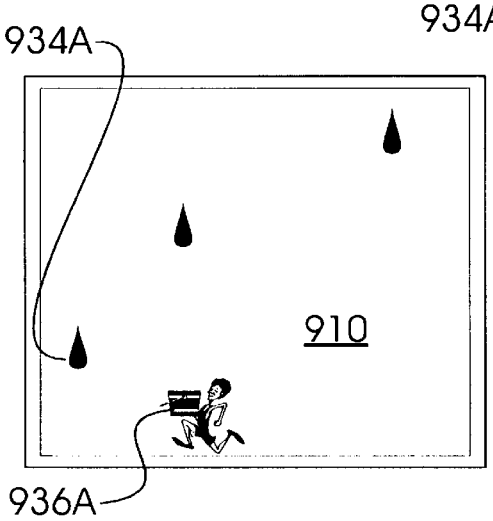
FIGS. 10A, 10B, 10C and 10D are a series of front views of the LCD screen of the apparatus of FIG. 7 showing a progression of successive visual action displays.
Figure 10B:
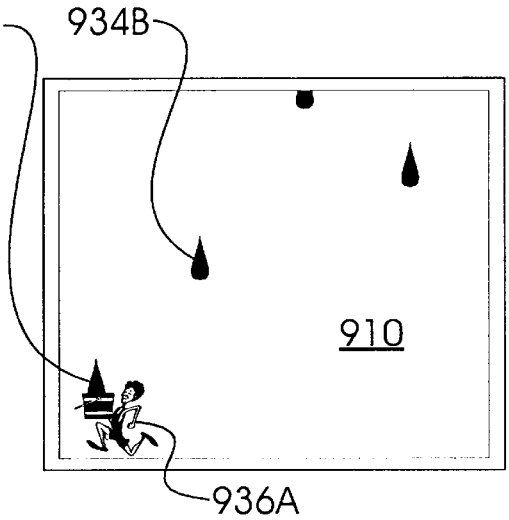
Figure 10C:
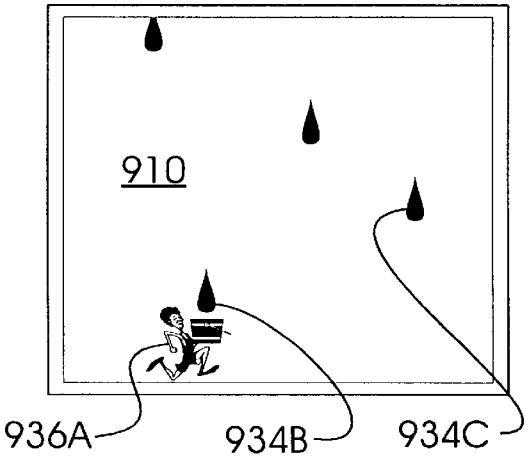
Figure 10D:
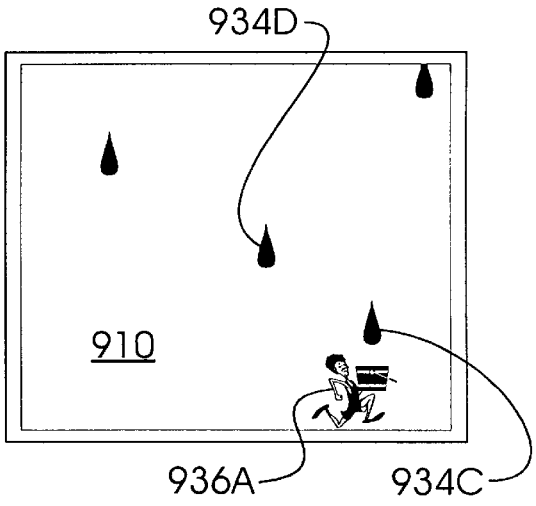

FIGS. 10A through 10D illustrate successive screens 910 for the play of the form of the game where an animated figure 936 is moved by the user side-to-side so as to catch large falling drops of water 934. FIG. 10A shows three drops falling. The animated figure, with a bucket or the like, is shown moving toward the left. In FIG. 10B, the animated figure has gotten to the far left and caught the left most falling drop. In FIG. 10C the animated figure has moved back right to catch a drop spaced somewhat from the left edge of the screen. It will be noted that the drops continue to fall downwardly. In FIG. 10D, the animated figure has moved further right to catch a falling drop. As noted above, if the animated figure does not get to a falling drop in time, she gets a fluid discharge from the outlet 912.

The operation of the apparatus 900 to achieve results like those of FIGS. 10A through 10D will now be explained in simplified generally non-technical terms, which appear adequate to understand and practice the present invention.

A round or player turn commences by activating the on/off switch 933. The pre-programmed microprocessor 928 sends electronic signals to the screen 910, to present action images such as shown in FIG. 10A. In particular, the signals define the location of each visual liquid drop 934 and each visual catching figure 936. By way of example, FIG. 30 shows ten possible signal paths spaced from left-to-right across the screen. For convenience of description these paths will be designated X1 through X10 proceeding left to right. Similarly, there are ten possible signal paths spaced from bottom-to-top that will be designated Y1 through Y10. Thus, each interaction of an X path and a Y path has a unique coordinate on the screen. The farthest left-bottom is X1, Y1, the farthest left-top is X1, Y10, the middle is X5, Y5.

The microprocessor 928 not only sends the pre-programmed signals to locate a drop at say coordinates X1, Y3 (shown as 934A in FIG. 10A), but also knows or retains that coordinate information. It also sends the signals to display the Figure 936A in FIG. 10A at some coordinate, and also retains the coordinate information. Thus, as shown in FIG. 10A, the drop 934A and the Figure 936A are at different coordinates,—and the drop is dropping! By FIG. 10B, the animated figure 936A has gotten to the same coordinate X1, Y1 as the drop 934A. One drop saved! But drop 934B is falling fast (FIG. 10B). If the animated figure 936A can get to drop 934B in time, disaster is averted. He did as shown in FIG. 10C. If drop 934B had gotten to X1, Y3 before animated figure 936A, the player would have been squirted. But there is no time to rest. Go after drop 934C. Got it in FIG. 10D. Here comes drop 934D, etc., etc., etc.

The player operates the directional buttons 911 to move the visual animated figure 936A left and right on the LCD screen 910. These commands, initiated by the buttons 911, pass to the microprocessor 928 that send and notes the coordinate information is to animated figure 936A at all times. The microprocessor is also preprogrammed so that if any liquid drop 936 reaches the X level and the animated figure is not also there, a signal goes to the motor/pump 917, 916 to initiate a discharge from outlet 912.

In the play of the just-described illustrated water dropping game, the tempo may change, such as start slower and speed up to build excitement.

Following are other examples of games that may be provided with the apparatus 900.

HYDRO CIRCUS BATTLE

You see one of three circus animals (an elephant, a seal, and a monkey holding a water bucket) one at a time on the screen. It is assumed that they are going to squirt you; but if you quickly touch their corresponding picture button first, they will not squirt and a new picture at random will pop up. If you do not hit the correct button fast enough you will get squirted. Your score is how many times you pressed the correct button at the right time.

HYDRO CAR CHASE

You are chasing a car filled with bad guys. You are on a two lane road where the car ahead is weaving in and out of traffic and you are dodging cars to keep right behind him. At random, someone pops up in the rear window ready to shoot at you. At the same time, you are maneuvering through traffic. If you don't cancel his shot, you will be sprayed.

HYDRO FISHING GAME

In this game, you are fishing for the big bass, but he is able to fight back. If you don't do the right things, the bass jumps out of the water and you get sprayed.

Thus, as generally with the other embodiments, the user places her face in front of the LCD screen 910 and begins the electronic action of the game. As the action scene on the screen progresses, the player is required to response in various ways to various actions observed on the screen. If the appropriate action is not taken, the discharge outlet 912 provides the liquid discharge against the user's face.

The apparatus may maintain a score by recording proper and improper actions by the user, with the play of the game continuing for a predetermined length of time or for a predetermined amount of actions or missactions.

Figure 11:
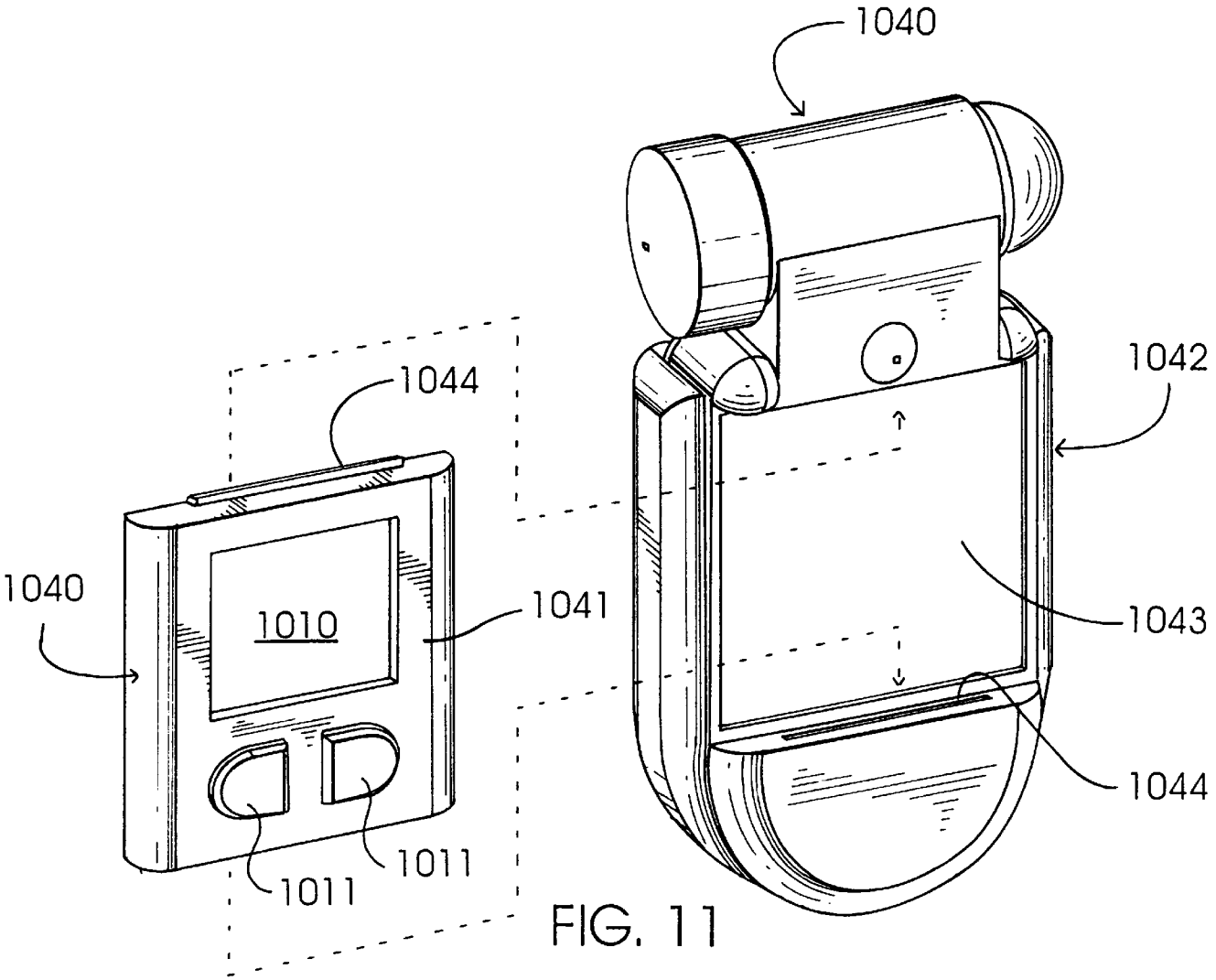
FIG. 11 is an exploded schematic front perspective view of a modified form of the apparatus of FIG. 7.
Figure 12B:
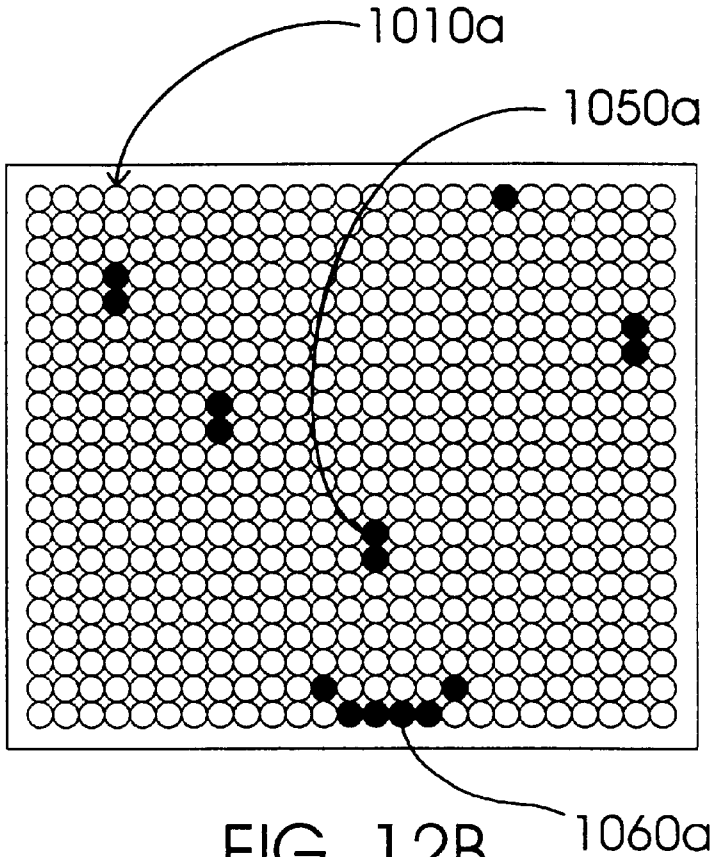
FIGS. 12A and 12B are schematic representations of a series of LED screens for an alternative form of apparatus.
Figure 12A:
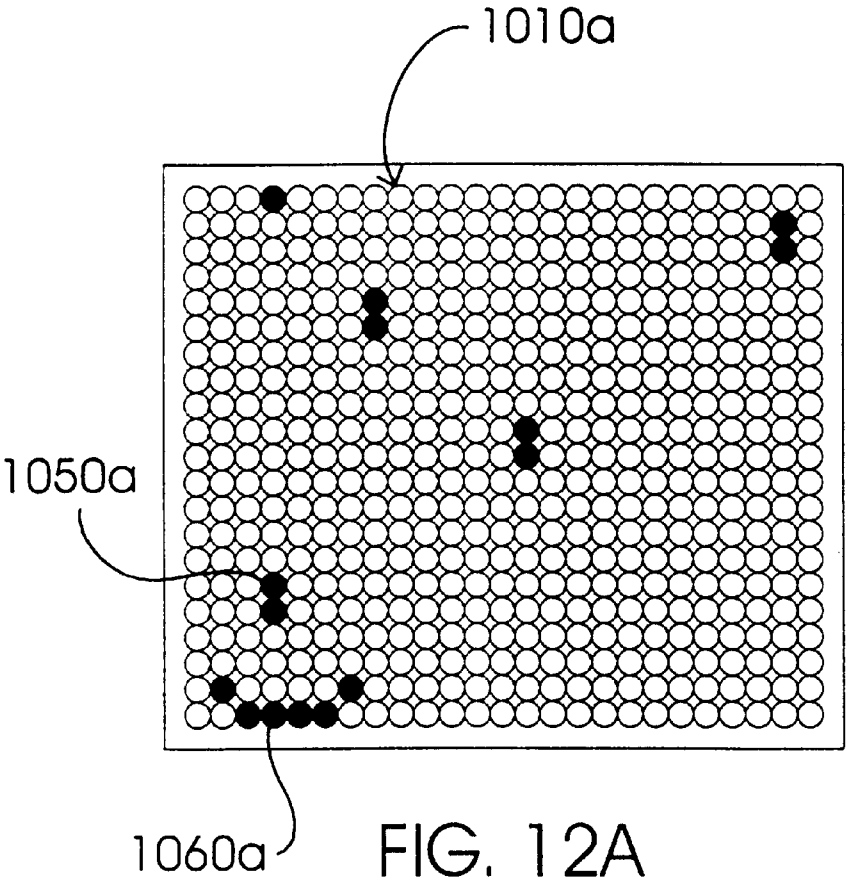

FIG. 11 shows an alternate embodiment in the form of play apparatus 1000 which is very similar to apparatus 900. This apparatus 1000 however has a replaceable cartridge 1040 which includes a cartridge housing or base section 1041. The base section 1041 supports an LCD screen 1010 and a pair of control buttons 1011, and contains a circuit board with a microprocessor chip that is connected to the screen and control buttons. The chip is preprogrammed for a particular game. The screen 1010 is an LCD character display for showing characters specific to that particular game and the control buttons 1011 are also specific to the play of that particular game. When mounted in the mating receptacle 1043 on the main base section 1042 of the game apparatus 1000 (as indicated by the arrows), necessary electrical connections are established through suitable electrical contacts 1044 on the top and bottom edges of the cartridge 1040 and in the receptacle 1043 on the main base section 1042. Thus, the LCD screen, control buttons, circuit board and microprocessor are connected to the remainder of the electrical circuit, i.e. the batteries, on/off switch, speaker and pump motor. The user can simply replace the cartridge 1040 with ones each having a different set or group of associated preprogrammed microprocessor, screen and control buttons to play a different game.

The presently preferred and illustrated form of screen 1010 is an LCD special character display. This display provides an LCD character in the shape of each individual visual item needed, i.e., liquid drops at each potential location and an animated figure with a bucket turned in either direction at each potential location. The LCD characters are energized or lit up selectively by the microprocessor as needed to provide the desired action display on the screen for the particular game. Such an LCD character display screen is very low cost and uses low power.

As noted above, for each additional different cartridge and new form of game, a new LCD character screen with different characters, and an associated microprocessor and set of control buttons may be provided.

Alternatively, one might design a line of games that used the same or very similar controls, so that a single set of control buttons could be provided on the main base rather than an associated set on each different cartridge. Such a special LCD screen is very low cost and uses low power.

For game applications, one might use an LCD graphical dot matrix display with somewhere between 200×200 dots per screen to 1024×1024 dots per screen. Such a display provides a high resolution image that can portray action well, but it is very expensive.

For some applications an LED dot matrix display with from 7×5 to 14×64 dots per screen might be utilized. FIGS. 33A and 33B show a form of the drop catching game using an LED dot matrix display, 1010A. Vertically aligned pairs of energized dots 1050A represent the drops and a six dot array 1060A represents a pail or container for catching the drops.

The game apparatus 900 or 1000 may be hand held, table top or self standing arcade games. The control means can be other than buttons, for example a rotatable dial, a slider, a joy stick, etc.

Various modifications and changes may be made in the illustrated without departing from the spirit and scope of the present invention as set forth in the following claims.

What is claimed is:

1. An interactive electronic game apparatus which has a predetermined manner of play, said apparatus comprising:

a. a base, b. a visually observable display comprising a screen mounted on the base, changing action images being provided on the screen, the changing images being visually observable by a player having her face positioned in a player area located generally in front of the screen, c. game control means on the base and selectively operable by the player to control the action of some but not all of the images on the screen in response to the action of the other images on the screen and in accordance with the predetermined manner of play of the game, and d. at least one game liquid discharge means positioned and arranged for directing a liquid discharge at the player area in response to the player operation of the control means.

2. The game apparatus of claim 1 wherein said screen is a graphic LCD display.

3. The game apparatus of claim 1 wherein said screen is a LCD character display.

4. The game apparatus of claim 1 wherein said screen is a LED display.

5. The game apparatus of claim 1 wherein said changing images portray a visual action sequence related to liquid.

6. The game apparatus of claim 1 wherein said changing images portray at least one visual action of discharging liquid at the game player.

7. The game apparatus of claim 1 further including a preprogrammed microprocessor connected to the screen, to the discharge means, and to the game control means.

8. The game apparatus of claim 7 wherein said base comprises a main base section with a cartridge receptacle, and a replaceable cartridge base section that is removably supported in said receptacle, said main and cartridges base sections each having electrical contact means that interengage when the cartridge base section is supported in said supported receptacle, said screen and said preprogramed microprocessor for play of a particular game being mounted on said cartridge base section.

9. The game apparatus of claim 8 further including at least one additional cartridge base section with a different preprogrammed microprocessor for play of a different game.

10. The game apparatus of claim 7 wherein said base is proportioned and designed to be held in the hand of the player, said base being in the form of a housing containing a battery compartment with electrical contacts for engaging batteries disposed in the compartment to connect the batteries to said microprocessor and said screen.

11. An electronic game apparatus which has a predetermined manner of play, said apparatus comprising:

a. a base, b. a visually observable display comprising a screen mounted on the base, changing action images being provided on the screen, the changing images being visually observable by a player having her face positioned in a player area located generally in front of the screen, c. game response means on the frame and selectively operable by the player in response to the action of the images on the screen and in accordance with the predetermined manner of play of the game, and d. at least one game liquid discharge means positioned and engaged for directing a liquid discharge at the player area in response to the player operation of the response means.

12. A method of playing an interactive electronic game apparatus which apparatus comprises a visually observable display comprising a screen capable of showing changing action images, there being a player area in front of the screen, the apparatus also including at least one liquid discharge means for directing a liquid discharge at the player area, and a control means operable by a player of the game to control the action of at least some but not all of the images shown on the screen, the game of the apparatus having a predetermined manner of play, said method of playing the game comprising:

a. showing a changing action image on the screen, b. allowing the game player to selectively operation the control means to control the action of some but not all of the images shown on the screen in response to the action of the other images shown on the screen and in accordance with the predetermined manner of play of the game, c. causing the liquid discharge means to direct a liquid discharge at the player area in response to some but not all operation by the player of the control means.

13. The method of claim 12 wherein said changing action image on the screen portrays an action sequence related to liquid.

14. The method of claim 11 wherein said changing action image on the screen portrays at least one visual action of discharging liquid at the game player.

* * * * *